US008266729B2

(12) United States Patent
Pagani

(10) Patent No.: US 8,266,729 B2
(45) Date of Patent: Sep. 18, 2012

(54) W.C. DISPENSER WITH PERFUMING CHAMBER

(75) Inventor: Fabio Pagani, Gazoldo Degli Ippoliti (IT)

(73) Assignee: Re.Le.Vi—S.p.A., Rodigo (Mantora) (IT)

( * ) Notice: Subject to any disclaimer, the term of this patent is extended or adjusted under 35 U.S.C. 154(b) by 1474 days.

(21) Appl. No.: 11/631,819

(22) PCT Filed: Jun. 15, 2005

(86) PCT No.: PCT/EP2005/006514

§ 371 (c)(1), (2), (4) Date: Jul. 2, 2007

(87) PCT Pub. No.: WO2006/005410

PCT Pub. Date: Jan. 19, 2006

(65) Prior Publication Data

US 2007/0240251 A1 Oct. 18, 2007

(30) Foreign Application Priority Data

Jul. 14, 2004 (IT) ..... RE2004A0084

(51) Int. Cl.
*E03D 9/02* (2006.01)

(52) U.S. Cl. ..... 4/231; 4/222; 4/223; 422/263; 422/266

(58) Field of Classification Search ..... 4/222, 223, 4/227.1, 231, 514; 239/34, 57, 289; 422/263, 422/266, 277

See application file for complete search history.

(56) References Cited

U.S. PATENT DOCUMENTS

| | | | | |
|---|---|---|---|---|
| 4,555,819 | A | 12/1985 | Weiss et al. | |
| 4,777,670 | A * | 10/1988 | Klinkhammer et al. | 4/231 |
| 6,651,261 | B1 * | 11/2003 | Leonard et al. | 4/231 |
| 6,662,380 | B1 * | 12/2003 | Leonard et al. | 4/231 |

FOREIGN PATENT DOCUMENTS

| | | | |
|---|---|---|---|
| DE | 100 44 371 | C1 | 4/2002 |
| EP | 1 522 319 | A | 4/2005 |
| GB | 1 098 923 | A | 1/1968 |
| GB | 2 391 186 | A | 2/2004 |
| WO | WO 95/25853 | A | 9/1995 |
| WO | WO 03/042462 | A | 5/2003 |
| WO | WO 03/078747 | A | 9/2003 |
| WO | WO 2004/081303 | A | 9/2004 |

* cited by examiner

*Primary Examiner* — Steven J Ganey
(74) *Attorney, Agent, or Firm* — Browdy and Neimark, PLLC

(57) ABSTRACT

The dispenser for a W.C. bowl comprises a support means (40) having a support (41, 42) for containing a first active substance in liquid or solid form and provided with at least one exit aperture (3) for said active substance; and hooking means (43) for supporting said support (41, 42) below the rim (21) of the W.C. bowl (20), in a position exposed to the action of the flushing water flow. According to the invention, at least one pocket (5) is provided, shaped to be associated with the outside of the support means (40), within said pocket (5) there being defined a chamber (6) comprising a perfuming substance or other active substance. Preferably, said perfuming substance is in the form of granules formed of absorbent plastic material. Alternatively, said perfuming substance is liquid and contained in an enclosure with an osmotic membrane.

12 Claims, 5 Drawing Sheets

W.C. DISPENSER WITH PERFUMING CHAMBER

TECHNICAL FIELD

The present invention relates to a W.C. dispenser with a perfuming chamber, to be housed within the W.C. bowl.

More particularly, the present invention relates to a W.C. dispenser comprising essentially, for containing an active substance, a container provided with an exit aperture and support means having a flexible elongated element able to assume the shape of a hook to support the container below the rim of the W.C. bowl in a position exposed to the action of the flush water flow.

BACKGROUND ART

Traditional dispensers in which the active substance is in the form of a solid body and which have the described characteristics have been known for some time.

Dispensers are also known in which the active substance is in the form of a liquid having the properties of cleaning and perfuming the W.C. bowl at each flushing operation, plus sanitizing and bactericidal properties.

These dispensers of the known art present certain drawbacks and disadvantages, in that to obtain all the desired properties several active principles have to be used which, when mixed together to form the liquid substance to be dispensed within the W.C. bowl, demonstrate incompatibilities of a chemical/physical character such as to decrease if not nullify the desired effects.

Consequently, there has recently been a considerable increase in the use of dispensers with their active substance in liquid form, in which the individual active principles which determine the desired results are kept separated within different chambers to be mixed when required, i.e. at each flushing operation, by systems of greater or lesser complexity and effectiveness.

Although these latter dispensers of the known art operate with a certain effectiveness with regard to cleaning, disinfecting and perfuming the W.C. bowl, this effectiveness is limited to the period immediately following the flush.

Hence, although this may be considered sufficient for cleaning and disinfecting the bowl, the same cannot be said for perfuming which is often required for a lengthy period, including during the absence of continuous use of the flush.

In this respect, those environments which use dispensers of the known art also very often use perfuming agents located in the immediate vicinity of the W.C. bowl to aid the insufficient perfuming action of the dispenser.

DISCLOSURE OF THE INVENTION

An object of the present invention is to provide a W.C. dispenser which can also act as a continuous perfumer or for another function (for example sanitizing), i.e. able to also act without being activated by the flush, to obviate the stated drawbacks with reference to the known art.

A further object is to provide a W.C. dispenser in which the perfuming substance does not come into direct contact with the active substance and which constantly releases a perfume even when the flush is not used.

A further object is to be able to use dispensers of the known art as elements of the invention.

These objects are attained by a W.C. dispenser as claimed in claim 1.

The dependent claims define preferred and particularly advantageous embodiments of the W.C. dispenser of the invention.

BRIEF DESCRIPTION OF THE DRAWINGS

Further characteristics and advantages of the invention will be apparent on reading the ensuing description provided by way of non-limiting example, with the aid of the figures shown in the accompanying drawings, in which.

Figure 1:
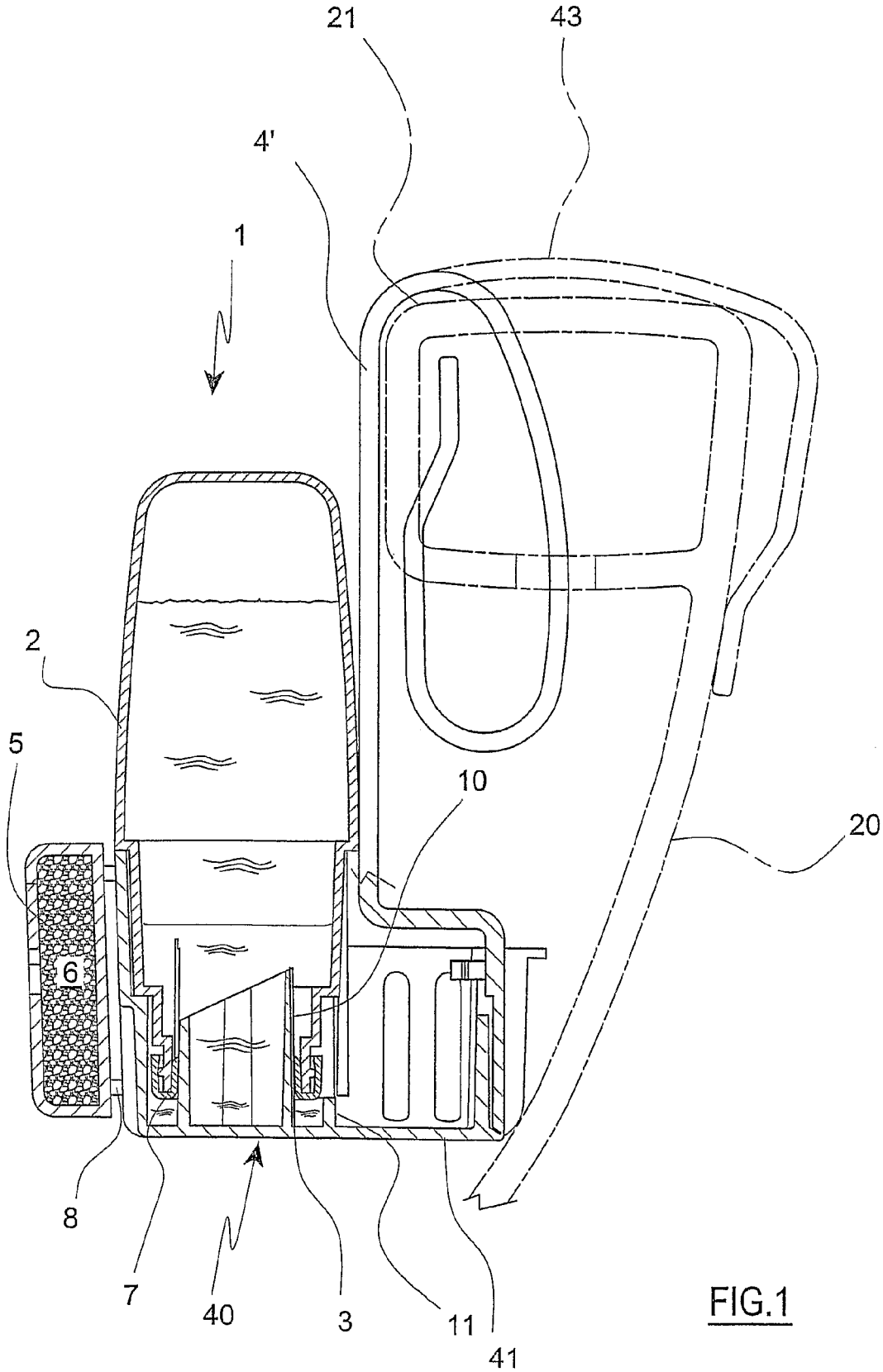
FIG. 1 is a section through a first embodiment of a dispenser of the present invention, for a liquid substance, taken on the vertical plane I-I of FIG. 2

With reference to said figures, the reference numeral 1 indicates overall a W.C. dispenser of the present invention.

The dispenser essentially comprises a support means 40 having a support for supporting an active substance in liquid or solid form and provided with at least one exit aperture for said active substance.

The active substance of the present invention can be either in the liquid state or in the solid state.

Figure 2:
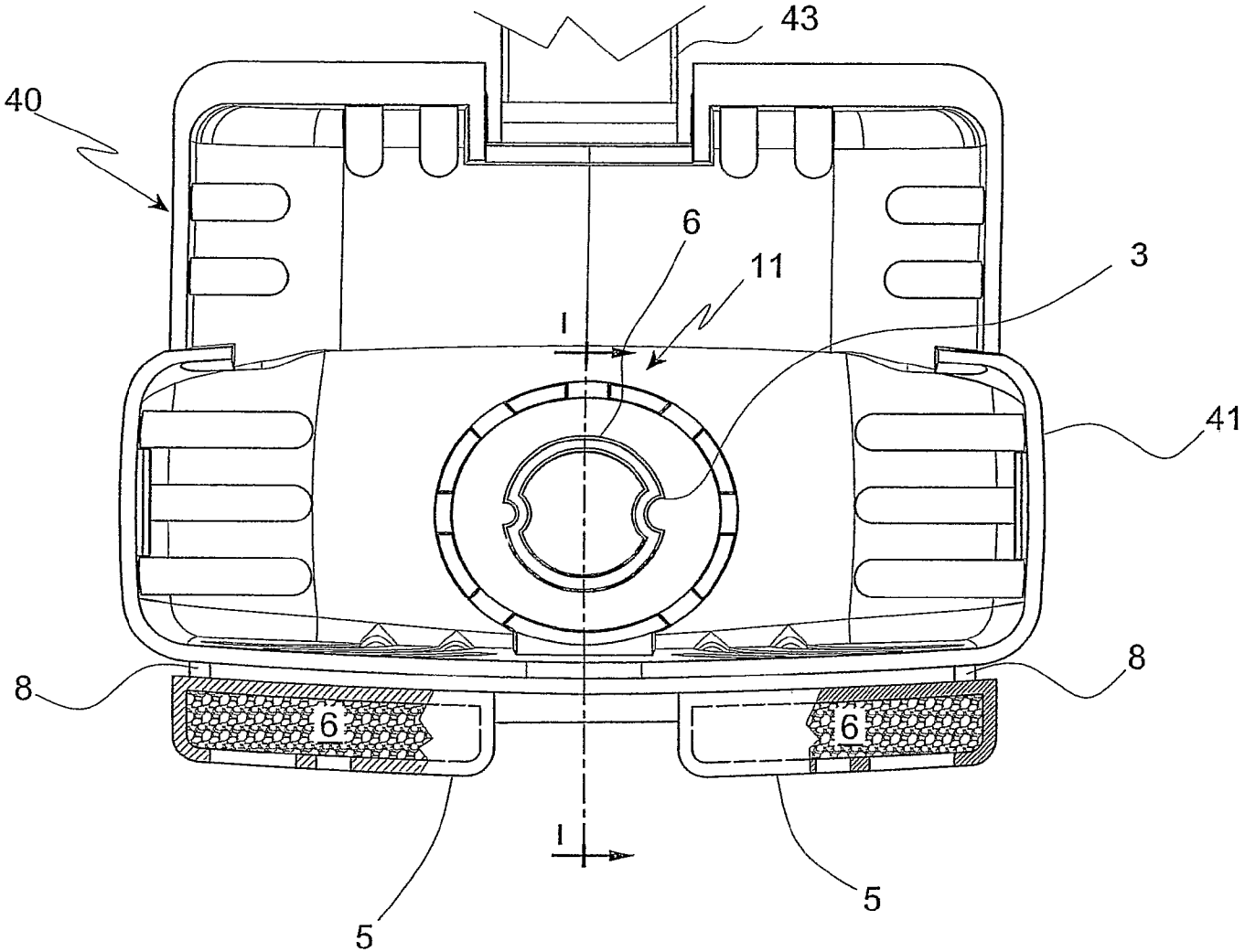
FIG. 2 is a plan view of the dispenser of FIG. 1 without the bottle.
Figure 3:
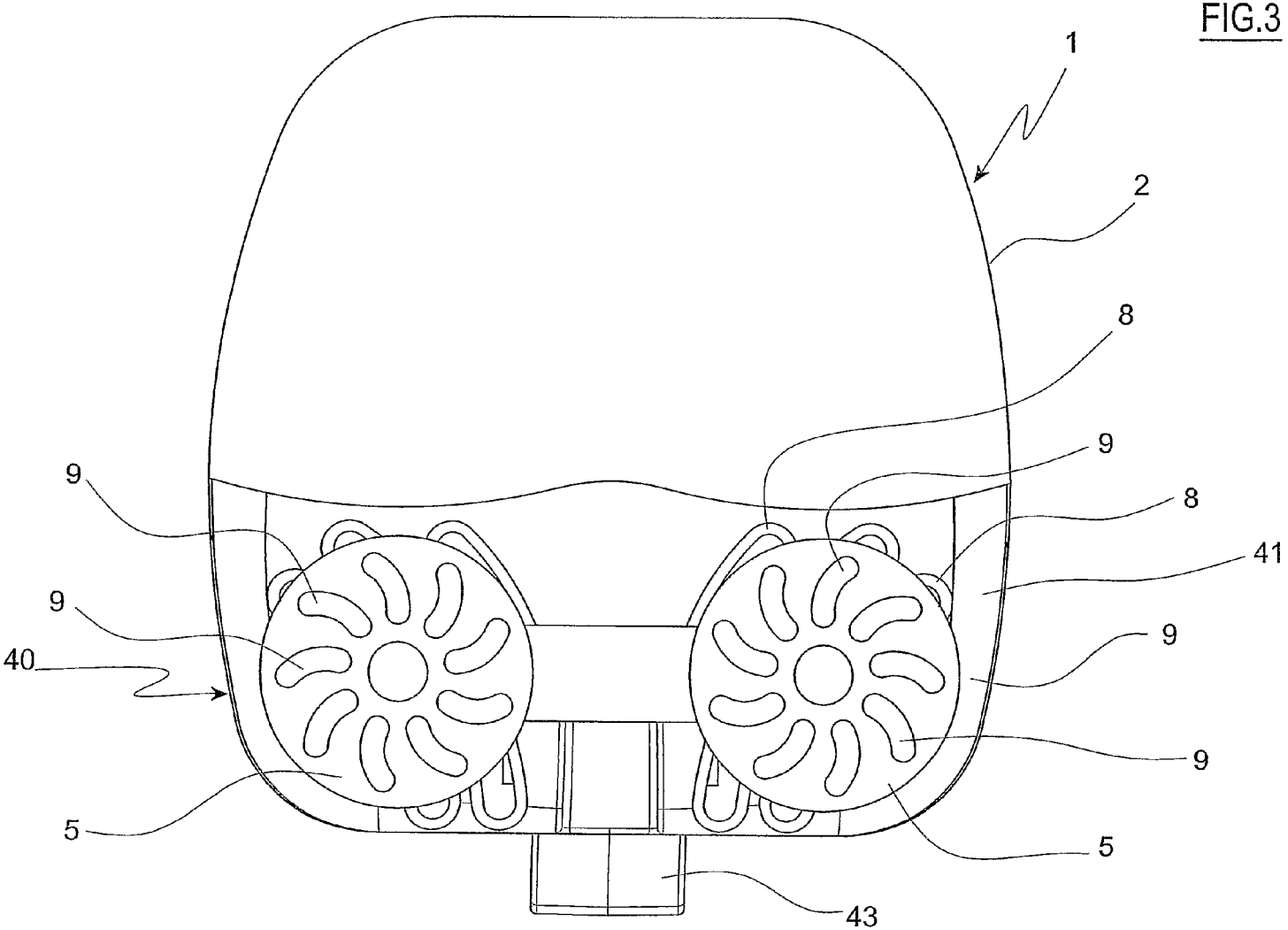
FIG. 3 is a front view of the dispenser of FIG. 1.

In the first case, the active substance (in a more or less viscous liquid state) able to clean and/or deodorize and/or refresh the air and/or disinfect is contained in a bottle 2 having an exit port 7 for the active substance (FIGS. 1-3).

In the second case, the container is in the form of a cage 42 for containing in its inner chamber an active substance in the form of a solid block 45 able to clean and/or deodorize and/or refresh the air and/or disinfect (FIGS. 4-7).

The support means (40) is arranged to support the bottle 2 or the solid block 45 in the W.C. bowl 40, against its inner surface below its upper rim 21, in a position exposed to the action of the flushing water flow.

Usually, the water flow emerges along the rim 21 from holes provided in its lower part or, in other cases, is made to emerge from a rear central mouth of the bowl 20 and made to flow in a tangential direction along the inner surface, below the rim 21.

According to the present invention, the dispenser 1 further comprises at least one pocket 5 defining in its interior a chamber 6 comprising a perfuming substance.

The pocket 5, which will be described in detail hereinafter, is shaped to be associated with the container exterior.

In the embodiment shown in FIGS. 1-3, the support means comprise a usual hooking means 43, in the form of a hook-shaped elongated element of elastically flexible material, by which it is hooked to the upper rim 21 of the W.C. bowl 20, and a support 41 comprising, for containing the active substance, a reservoir 11 having an upwardly facing concavity (when in its normal use position) located in a position exposed to the action of the flushing water flow to receive the mouth 7 of the bottle 2, and a closure member 10 positioned within said containing reservoir 11 to close the mouth 7 of the bottle 2 and controlledly dispense the substance contained in the reservoir 11.

Essentially, the support 41 enables the bottle 2 to remain in a vertical position.

Although explicitly referring to a bottle 2 with a single chamber containing the active substance, any other type of bottle 2 shaped to receive two or more liquid and/or solid substances divided by internal separation baffles can be used.

In the first embodiment, said pocket 5 is in the form of two pockets coupled to the outside of the support means 40 such that they lie side by side (FIGS. 1-3). Specifically, the pockets 5 are coupled to the support 41.

Figures 4, 5, 6, 7:
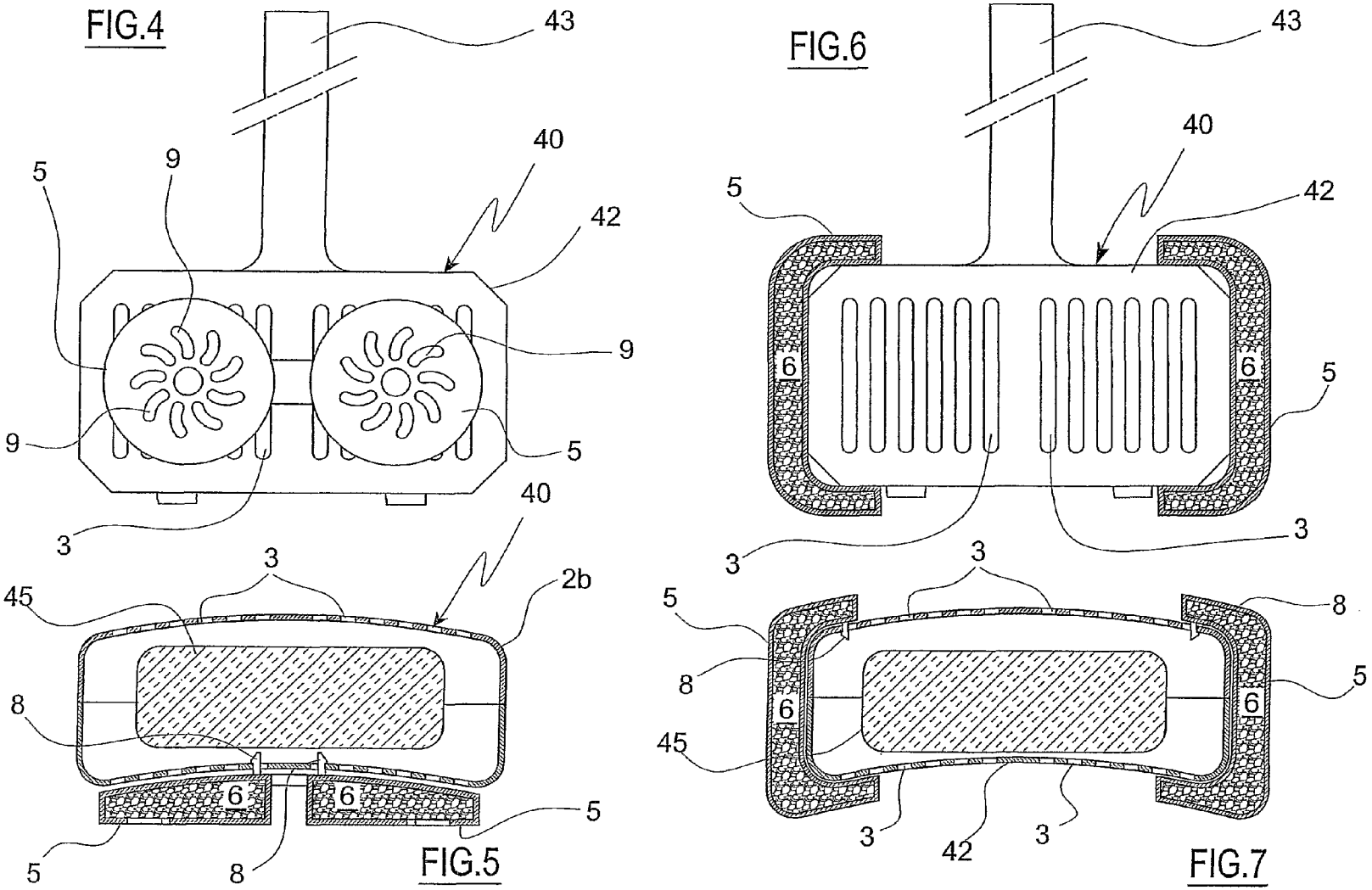
FIG. 4 is a schematic front view of a second embodiment of a dispenser of the present invention, for a solid substance.
FIG. 5 is a section on the horizontal plane V-V of FIG. 4.
FIG. 6 is a schematic front view of a third embodiment of a dispenser of the present invention, for a solid substance.
FIG. 7 is a section on the horizontal plane VII-VII of FIG. 6.

In the second embodiment, two pockets are provided totally similar to those of the first embodiment, but are here coupled to the cage-shaped support 42 (FIGS. 4 and 5).

In a third embodiment, two pockets 5 are provided coupled to the dispenser so that they lie opposite each other (FIGS. 6, 7).

In the illustrated example they are coupled to the lateral edge of the cage 42 and embrace for a limited portion the remaining two opposing walls.

In a fourth embodiment there is a single pocket 5 coupled to the outside of the support means 40.

Figure 8:
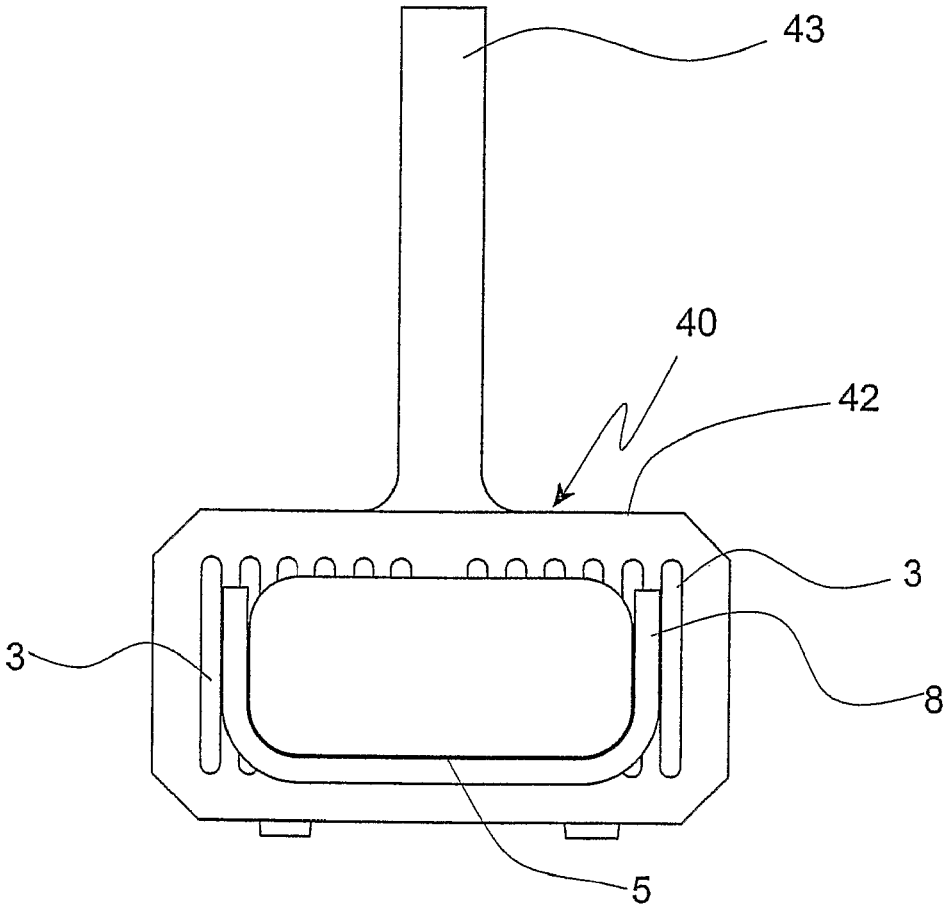
FIG. 8 is a schematic front view of a fourth embodiment of a dispenser of the present invention, for a solid substance.
Figure 9:
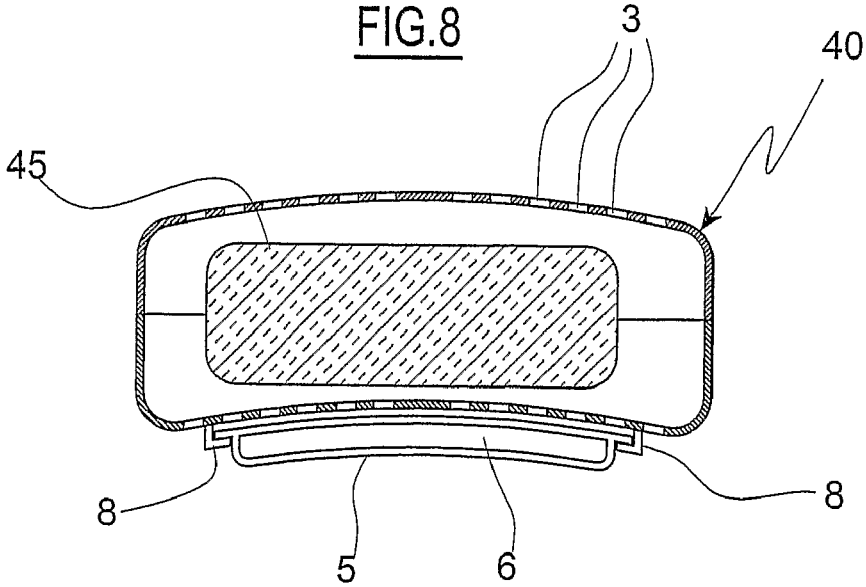
FIG. 9 is a section on the horizontal plane IX-IX of FIG. 8.

In the illustrated example the pocket 5 is coupled to one side of the cage 42 (FIGS. 8, 9).

The pockets 5 comprise at least one aperture 9 communicating with the inner chamber 6 in which the perfuming substance is placed, and coupling means 8 for coupling them to the support means 40.

The pockets containing the perfuming substance can have any number and arrangement, according to preference.

The coupling means 8 are for example in the form of hooks jutting from one side of the pockets 5, to hook onto respective recesses provided in the container, and usually already present.

Clips or glue can be used as an alternative to hooks.

The use of removable or non-removable coupling means is left to personal preference.

The pockets could also be associated with the outside of the support means 40 by being formed integral with it.

As can be seen in FIGS. 3 and 4, the pockets 5, located on one side of the support means 4, are of circular shape, said aperture 9 which communicates with the inner chamber 6 being in the form of a plurality of slots 9 disposed on the side opposite that coupled to the support means 40 or on both sides, to enable the perfume to diffuse outwards.

In the example, said slots 9 are disposed radially starting from the central point.

The pockets 5 can also be of C-shape as shown in FIGS. 6 and 7, where these are located opposing each other and at least partially embrace the support means 40, which is the cage 42 in the illustrated example.

The perfuming substance is preferably in the form of granules or a liquid contained in an enclosure with an osmotic membrane which enables the perfume to emerge but prevents it from escaping even when exposed to repeated water flushes.

An example of a perfuming substance used inside an enclosure with an osmotic membrane is the following:

| | |
|---|---|
| perfume | 1-10 g |
| thickener (amorphous silica or ethyl cellulose) | 0-2% |
| propylene glycol | 0-2%, |

this latter being used as an evaporation aid.

As a perfuming substance in the form of granules, it has been found that granules comprising a plastic support consisting essentially of EVA (ethyl vinyl acetate) present a perfume absorption capacity of up to a maximum of about 30%, whereas supports consisting essentially of hollow polymers can absorb up to 200% of their weight of perfume, ensuring a longer perfuming duration.

With granules of this type, it has been found that under the repeated action of water flushes to which the dispenser is exposed, the diffusive capacity of the perfume is not even minimally influenced.

In contrast, if the granules are used with an antibacterial or disinfectant substance, in the absence of a wash water flow the substance remains trapped in the respective granules without dispersing.

Moreover, their capacity for absorbing antibacterial, disinfectant and similar agents is limited to a maximum of 10% by weight.

As will be apparent from the aforegoing description, the W.C. dispenser with a perfuming chamber according to the present invention satisfies the requirements and overcomes the drawbacks stated in the introduction to the present description with reference to the known art.

In this respect, the perfuming action of the dispenser of the present invention acts constantly for at least the entire life of the active substance, whether the action of the flushing water flow is absent or present.

When the life of the perfuming substance ends, the pockets 5 can be replaced with new pockets, to be associated with the same support means 40. Likewise the enclosure with its osmotic membrane can be replaced within the same pocket 5.

In place of a perfuming substance, or in addition thereto, the pockets 5 can contain an active substance with a different function, for example for sanitizing.

An expert of the art can apply numerous modifications and variants to the aforedescribed W.C. dispenser to satisfy specific contingent requirements, all of which however are contained within the scope of protection of the invention, as defined by the following claims.

The invention claimed is:

1. A dispenser for a W.C. bowl, comprising:

a support device (40) having a support (41, 42) for containing a first active substance in liquid or solid form and provided with at least one exit aperture (3) for said active substance;

hooking device (43) for supporting said support (41, 42) below a rim (21) of the W.C. bowl (20), in a position exposed to the action of the flushing water flow, at least one pocket (5), shaped to be associated with the support device (40), within said at least one pocket (5) there being defined a chamber (6) comprising a perfuming substance or other active substance, wherein the at least one pocket (5) comprises hooks (8) jutting from the at least one pocket (5) or from the support (41, 42) for removably coupling the at least one pocket (5) to the support device (40), the at least one pocket (5) being placed externally of the support (41, 42) and associated with an outside surface of the support (41, 42).

2. A dispenser as claimed in claim 1, wherein said support (41, 42) for containing a first active substance has recesses, wherein said hooks (8) to hook onto respective ones of said recesses.

3. A dispenser as claimed in claim 2, wherein said granules are formed of absorbent plastic material.

4. A dispenser as claimed in claim 1, wherein said perfuming substance is in the form of granules.

5. A dispenser as claimed in claim 4, wherein said plastic material is chosen from EVA and hollow polymers.

6. A dispenser as claimed in claim 1, wherein said perfuming substance is liquid and is contained in an enclosure with an osmotic membrane.

7. A dispenser as claimed in claim 1, wherein said perfuming substance acts constantly during the life to said active substance, even when the action of the flushing water flow is absent.

8. A dispenser as claimed in claim 7, wherein said at least one pockets comprises two pockets (5).

9. A dispenser as claimed in claim 8, wherein said two pockets (5) are coupled to the dispenser such that they lie side by side.

10. A dispenser as claimed in claim 8, wherein said two pockets (5) are coupled to the dispenser such that they lie opposite each other.

11. A dispenser as claimed in claim 1, wherein said first active substance is in the liquid state.

12. A dispenser as claimed in claim 1, wherein said first active substance is in the solid state.

* * * * *